US007401585B2

(12) United States Patent
Shirataki

(10) Patent No.: US 7,401,585 B2
(45) Date of Patent: Jul. 22, 2008

(54) STARTER APPARATUS FOR VEHICLE

(75) Inventor: Hirobumi Shirataki, Fukuroi (JP)

(73) Assignee: NSK-Warner K.K., Tokyo (JP)

( * ) Notice: Subject to any disclaimer, the term of this patent is extended or adjusted under 35 U.S.C. 154(b) by 0 days.

(21) Appl. No.: 11/790,409

(22) Filed: Apr. 25, 2007

(65) Prior Publication Data

US 2007/0251482 A1 Nov. 1, 2007

(30) Foreign Application Priority Data

Apr. 28, 2006 (JP) ..... 2006-126163

(51) Int. Cl.
*F02N 11/00* (2006.01)
*F02N 15/02* (2006.01)

(52) U.S. Cl. ..... 123/179.25

(58) Field of Classification Search ..... 123/179.25, 123/179.24
See application file for complete search history.

(56) References Cited

U.S. PATENT DOCUMENTS 6,295,487 B1 * 9/2001 Ono et al. ..... 701/22
6,616,569 B2 * 9/2003 Hoang et al. ..... 477/3

FOREIGN PATENT DOCUMENTS

JP 2000-274337 10/2000
JP 2006-63902 3/2006

* cited by examiner

*Primary Examiner*—Stephen K. Cronin
*Assistant Examiner*—Arnold Castro
(74) *Attorney, Agent, or Firm*—Miles & Stockbridge P.C.

(57) ABSTRACT

In a vehicle starter apparatus incorporating therein a starting motor and a one-way clutch, a damper for mitigating vibration of an engine is disposed at a position between the one-way clutch and the engine, and at the same time, between the engine and a transmission.

2 Claims, 2 Drawing Sheets

STARTER APPARATUS FOR VEHICLE

BACKGROUND OF THE INVENTION

This application claims the benefit of Japanese Patent Application No. 2006-126163 which is hereby incorporated by reference.

1. Field of the Invention

The present invention relates to a vehicle starter apparatus that is used in a starter apparatus of a vehicle.

2. Related Background Art

Generally, a vehicle engine is driven to start from a starting motor via a one-way clutch.

When the engine is started and when the number of rotations of an output-side member of the one-way clutch caused by means of the engine exceeds the number of rotations of an input-side member of the one-way clutch caused by the starting motor, the one-way clutch starts to run idle.

Normally, while the engine is driven, the one-way clutch runs idle, so that rotation from the engine is intercepted by the one-way clutch, whereby the starting motor is prevented from being rotated and damaged.

For example, in the Japan Patent Application Laid-Open No. 2006-63902, a crankshaft pulley of the engine is attached to a crank shaft through a clutch and is coupled to a starter pulley of the starter apparatus through a starting belt. The clutch is a one-directional clutch that transmits a drive torque to the crank shaft from the crankshaft pulley at a starting time of the engine and intercepts the drive torque from the crank shaft to the crankshaft pulley after the starting of the engine. Accordingly, since the clutch is disengaged after the engine start, when the starter apparatus is turned off to stop rotation of the starting motor, the rotation of the starting belt and that of the crankshaft pulley are also stopped. With this arrangement, while the engine is driven, a torque generated by the engine is not consumed to rotate the starting belt, so that the torque loss can be reduced.

In the Japan Patent Application Laid-Open No. 2000-274337, the starter apparatus is provided with a pinion gear attached to an output shaft of a starting motor and a ring gear meshed with the pinion gear. The pinion gear is formed of a helical gear that is provided with a scissors gear mechanism. The ring gear is formed of a helical gear that can mesh with the pinion gear. The ring gear is disposed on the crank shaft of an internal combustion engine, and is always meshed with the pinion gear. Between the ring gear and the crank shaft, there is provided a one-way clutch that allows transmission of driving force only from the starting motor side to the internal combustion engine side.

The present invention has been contrived taking such circumstances as described above into consideration, and an object thereof is to provide a vehicle starter apparatus that can prevent rollover (a damage of a one-way clutch due to an excessive load) of the one-way clutch and mitigate vibration of an engine by a damper, thereby preventing fatigue damage or abrasion of a spring that is used in the one-way clutch, so that the one-way clutch may be prevented from being damaged.

In order to achieve the above object, according to the present invention, there is provided a vehicle starter apparatus that incorporates therein a starting motor and a one-way clutch, characterized in that:

a damper for mitigating vibration of an engine is disposed at a position between the one-way clutch and the engine, and at the same time, between the engine and a transmission.

According to the present invention, a damper for reducing vibration of an engine is disposed at a position between a one-way clutch and the engine, and at the same time, between the engine and a transmission. With this arrangement, for example, an impact torque in a reverse direction, that may be caused by erroneous ignition of the engine at the starting time, is reduced by the damper and the torque to be inputted to an output member of the one-way clutch is mitigated.

As a result, it is rendered possible to prevent rollover (a damage of the one-way clutch due to an excessive load), and to mitigate vibration of the engine by means of the damper, thereby preventing fatigue damage or abrasion of a spring that is used in the one-way clutch so that the one-way clutch may be prevented from being damaged.

DETAILED DESCRIPTION OF THE MOST PREFERRED EMBODIMENTS

A vehicle starter apparatus according to an embodiment of the present invention will be described below with reference to the drawings.

Figure 1:
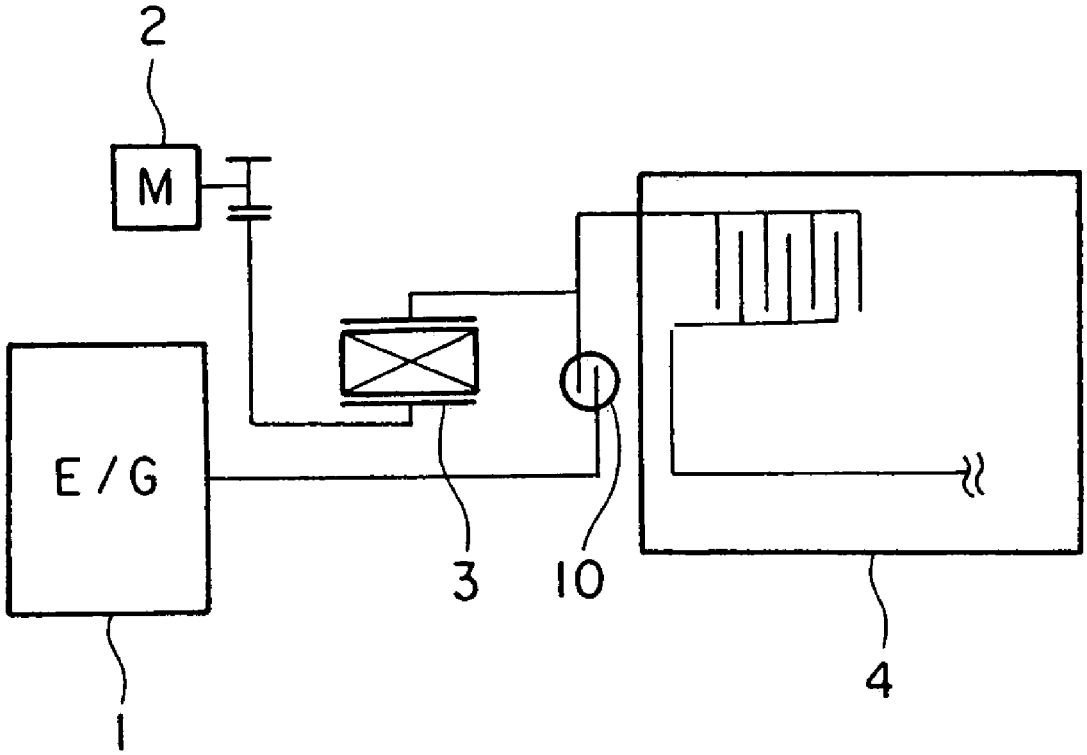
FIG. 1 is a schematic block diagram of a vehicle starter apparatus according to an embodiment of the present invention.

FIG. 1 is a schematic block diagram of the vehicle starter apparatus according to the embodiment of the present invention.

Referring to FIG. 1, reference numeral 1 denotes an engine; 2 a starting motor; 3 a one-way clutch; and 4 a transmission. Reference numeral 10 denotes a damper that will be specifically described later.

As the one-way clutch 3, a one-way clutch of a disengage type that is conventionally used as a starting clutch is employed.

Figure 2:
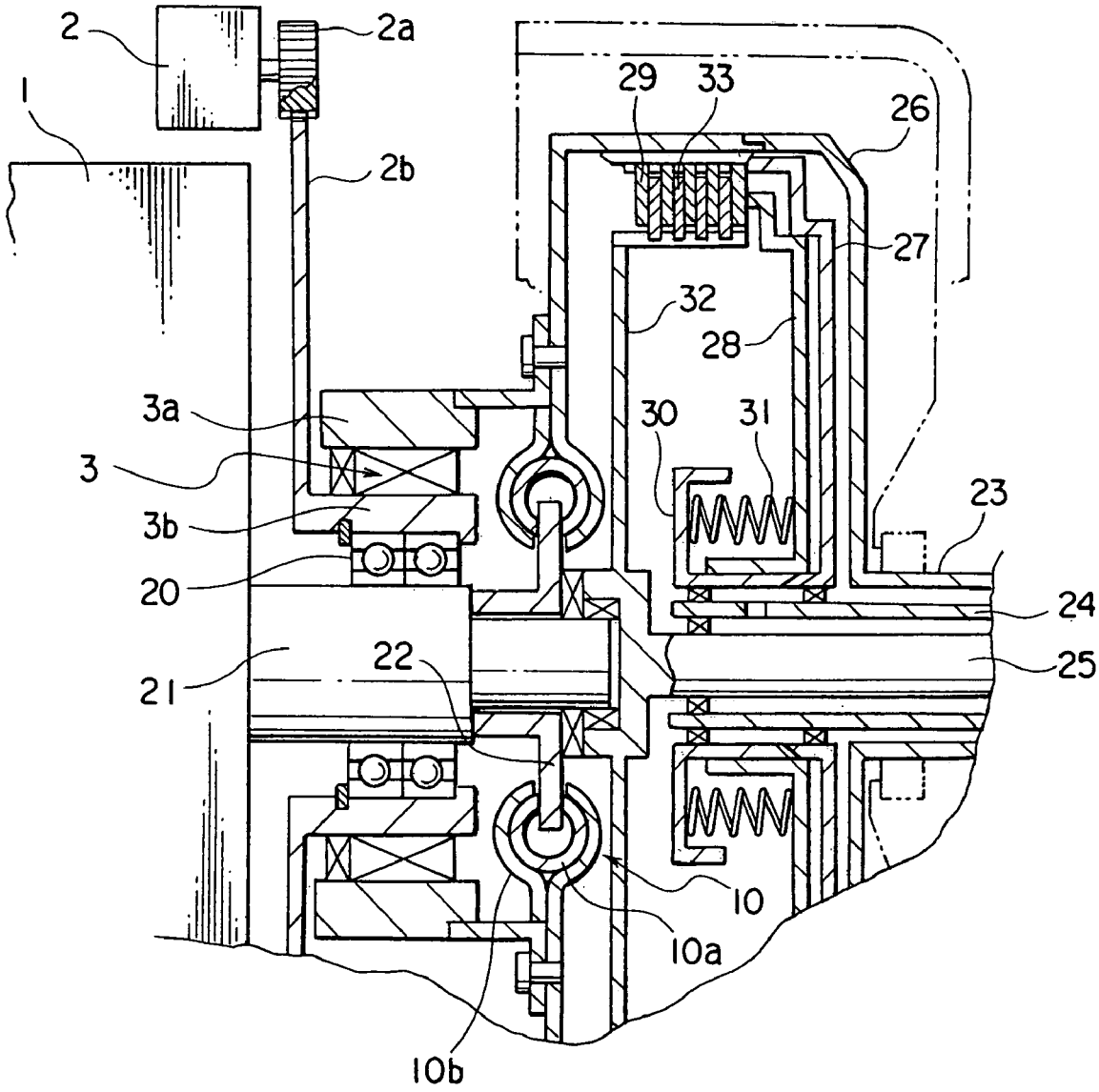
FIG. 2 is a schematic cross-sectional view of the vehicle starter apparatus shown in FIG. 1.

FIG. 2 is a schematic cross-sectional view of the vehicle starter apparatus shown in FIG. 1.

Referring to FIG. 2, when an outer race 3*a* of the one-way clutch 3 is rotated, an inner race 3*b* and a meshing member (a sprag or a roller) disposed between the outer race 3*a* and the inner race 3*b* are brought into non-contact state if the number of rotations of the outer race 3*a* exceeds a predetermined value to cause an idle running state, whereby abrasion of the meshing member and the inner race 3*b* at idling time can be prevented.

The starting motor 2 is always coupled to the inner race 3*b* of the one-way clutch 3 through a pinion gear 2*a* and a ring gear 2*b*.

A crank shaft 21 of the engine 1 is provided on the inner race 3*b* of the one-way clutch 3 through a bearing 20.

A hub 22 is spline-coupled with the crank shaft 21. The damper 10 that will be specifically described later is mounted on the hub 22. Note that reference numeral 10*a* denotes a spring and reference numeral 10*b* denotes a retainer.

A starting clutch is comprised of a sleeve 23, a fixed shaft 24 that is provided on the inner side of the sleeve 23, and an input shaft 25 that is provided on the inner side of the fixed shaft 24.

The sleeve 23 is a part of a housing 26, and a clutch case 27 of the starting clutch is provided inside the housing 26. The clutch case 27 is rotated integrally with the housing 26.

A clutch piston 28 is provided in the clutch case 27 to be slidable in the axial direction.

A plurality of separator plates 29 that are slidable in the axial direction are provided in a cylindrical portion on the outer periphery of the clutch case 27 through a spline at predetermined intervals in the axial direction.

An inner peripheral cylindrical portion of the clutch case 27 is fitted to the fixed shaft 24 through a bearing. A flange portion 30 that is extended outward in the radial direction is provided in the inner peripheral cylindrical portion of the clutch case 27, and a spring 31 is disposed between the flange portion 30 and the clutch piston 28. The spring 31 imparts a force for pressing the clutch piston 28 on the inner peripheral surface of the clutch case 27.

An end portion of the input shaft 25 of the starting clutch serves as a hub 32 in a disc shape. A plurality of frictional plates 33 are provided to be slidable in the axial direction on a cylindrical portion of the hub 32 at predetermined intervals in the axial direction through a spline. It is needless to say that the number of the separator plates 29 and the number of frictional plates 33 can be arbitrarily determined. It is also possible to provide frictional members that are stuck onto the frictional plates 33 on either one side or both sides of the frictional plates.

Here, a driving force transmission route of the starting clutch will be described below. When the starting clutch is engaged, the driving force is transmitted to the clutch case 27 of the starting clutch that is rotated integrally with the housing 26, and then transmitted to the input shaft 25 of the starting clutch through the separator plates 29 that are coupled to the clutch case 27 through a spline, the frictional plates 33 that are pressed on the separator plates 29 by the piston 28, and the hub 32. The driving force having been transmitted to the input shaft 25 is transmitted to the transmission 4.

Next, when the starting clutch is disengaged, the driving force is transmitted to the clutch case 27 of the starting clutch that is rotated integrally with the housing 26, and then transmitted to the separator plates 29 that are coupled to the clutch case 27 through a spline. However, when the starting clutch is disengaged, the separator plates 29 and the frictional plates 33 are disconnected from each other so that the driving force is not transmitted from the separator plates 29 to the frictional plates 33. Accordingly, the starting clutch falls into a neutral state.

Incidentally, in the present embodiment, as shown in FIG. 1 and FIG. 2, the damper 10 for mitigating vibration of the engine is disposed at a position between the one-way clutch 3 and the engine 1, and at the same time, between the engine 1 and the transmission 4.

With this arrangement, for example, an impact torque in a reverse direction, that may be caused by erroneous ignition of the engine at the starting time, is reduced by the damper 10 and the torque to be inputted to an output member of the one-way clutch 3 is mitigated.

As a result, this arrangement is useful for preventing fatigue damage or abrasion of a spring that is used in the one-way clutch 3, because rollover (a damage of the one-way clutch due to an excessive load) can be prevented and the vibration of the engine 1 can be mitigated by the damper 10 when the one-way clutch 3 runs idle, so that the one-way clutch 3 is prevented from being damaged.

In the present invention, the transmission can be used either in a conventional manual transmission system or in an automatic transmission system.

In a manual transmission system and an automatic transmission system with a lock-up clutch, usually a damper is used. However, in the present invention, the function of a conventional damper and the role of a damper for a one-way clutch can be performed by a single damper.

When both a damper to be used in a conventional transmission and the damper 10 of the present invention are used, higher degree of freedom can be obtained in a damper arrangement with the two dampers.

Note that the present invention is not limited to the above-described embodiment, and can be altered in various manners.

What is claimed is:

1. A vehicle engine starter apparatus comprising a starting motor and a one-way clutch connected to a rotation transmitting path from a crank shaft of the engine to an input member of a transmission to transmit rotation of the starting motor to the engine for starting the engine, being characterized in that a damper for preventing vibration of the engine from being transmitted to the one-way clutch is disposed in said rotation transmitting path between the crank shaft of said engine and said one-way clutch.

2. A vehicle engine starter apparatus comprising a starting motor and a one-way clutch, wherein the starting motor is connected to the vehicle engine through the one-way clutch and through a damper for preventing vibration of the engine from being transmitted to the one-way clutch, and wherein the vehicle engine is connected to a transmission through the damper.

* * * * *